United States Patent [19]

Becker et al.

[11] 4,327,920

[45] May 4, 1982

[54] ELECTROMECHANICAL DECISION MAKING BOARD GAME

[75] Inventors: James R. Becker, New York; Julius Cooper, New Hyde Park; Fredric M. Kuriloff, New York, all of N.Y.

[73] Assignee: Ideal Toy Corporation, Hollis, N.Y.

[21] Appl. No.: 130,979

[22] Filed: Mar. 17, 1980

[51] Int. Cl.[3] ..... A63F 3/00

[52] U.S. Cl. ..... 273/238

[58] Field of Search ..... 273/255, 262, 265, 288, 273/237, 238

[56] References Cited

U.S. PATENT DOCUMENTS

| | | | |
|---|---|---|---|
| 3,481,604 | 12/1969 | Fan | 273/238 |
| 3,823,943 | 7/1974 | Chamecki | 273/237 |
| 4,089,529 | 5/1978 | Usami | 273/287 |

OTHER PUBLICATIONS

"*The Generals Electronic Strategy Game*", Games Magazine, Mar./Apr. 1981.

*Primary Examiner*—Vance Y. Hum
*Assistant Examiner*—Leo Picard
*Attorney, Agent, or Firm*—Charles E. Temko

[57] ABSTRACT

An electromechanically controlled board game for two players, each of which has a set of playing pieces which are advanced on a board in rank or file increments to attack pieces of the opposing player. The pieces are so configured that the relative value of each piece is visible only to the holder of the piece during play. An attacking piece is compared in value with the piece attacked by comparing a four bit code assigned to each piece with a corresponding code assigned to the piece attacked. The lower valued piece is considered captured, and is retired without disclosure of its relative value to the opposing player. Each side has one piece designated "flag" the object of the game being to capture the flag of the opposing side.

4 Claims, 7 Drawing Figures

ELECTROMECHANICAL DECISION MAKING BOARD GAME

BACKGROUND OF THE INVENTION

This invention relates generally to the field of board games using movable playing pieces, and played by two players, in which the object is to capture as many of the opposing pieces as possible, as in the game of checkers, or a single particular piece, as in the game of chess.

Such games are characterized in almost all instances by the fact that each piece has been assigned a specific value in terms of rank relative to the other pieces, and the value is readily apparent not only to a player holding the piece, but to his opponent as well. As captured pieces are retired, each player is in a position to continuously assess his position relative to that of his opponent, and decide upon subsequent moves based upon such assessments.

In military contests, a commander must often make decisions based upon estimated strength of his opponent, without actual knowledge. In such instances, his decisions must be made in the absence of knowledge of changes in strength which occur during a campaign, or, for that matter, a single encounter. Victory or defeat will, in such cases, depend upon the ability of the commander to guess the correct course, based upon such knowledge as he may have at the moment.

SUMMARY OF THE INVENTION

Briefly stated, the invention contemplates the provision of an improved board game which, to a considerable degree, requires the exercise of judgment and decision in the absence of total factual knowledge of the relative strength of the opposing player. To this end, there is provided a board having a plurality of squares constituting a playing area. Each of two players has a set of playing pieces which are substantially similar in external appearance, and which have a shielded surface which may be recessed so as to be visible only to the holder of the piece when the piece is properly positioned on the board. This surface is provided with an indication of the value of the piece in terms of rank. The pieces are moved in accordance with predetermined rules from delineated square to square, and an opposing piece is attacked by moving the attacking piece to the square occupied by the piece being attacked. The piece having the higher value or rank prevails, and this is electromechanically determined by placing both pieces in position for the reading of a four bit code incorporated into the base of each piece. The codes are compared, and a visible signal or audible signal indicates the winning side in a specific battle. The losing piece is retired by the holder without disclosing to the opponent the value or rank of the retired piece, following which the same continues. One piece on each side is designated as a principal piece, the capture of which results in total victory for the capturing side.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figures 1, 5:
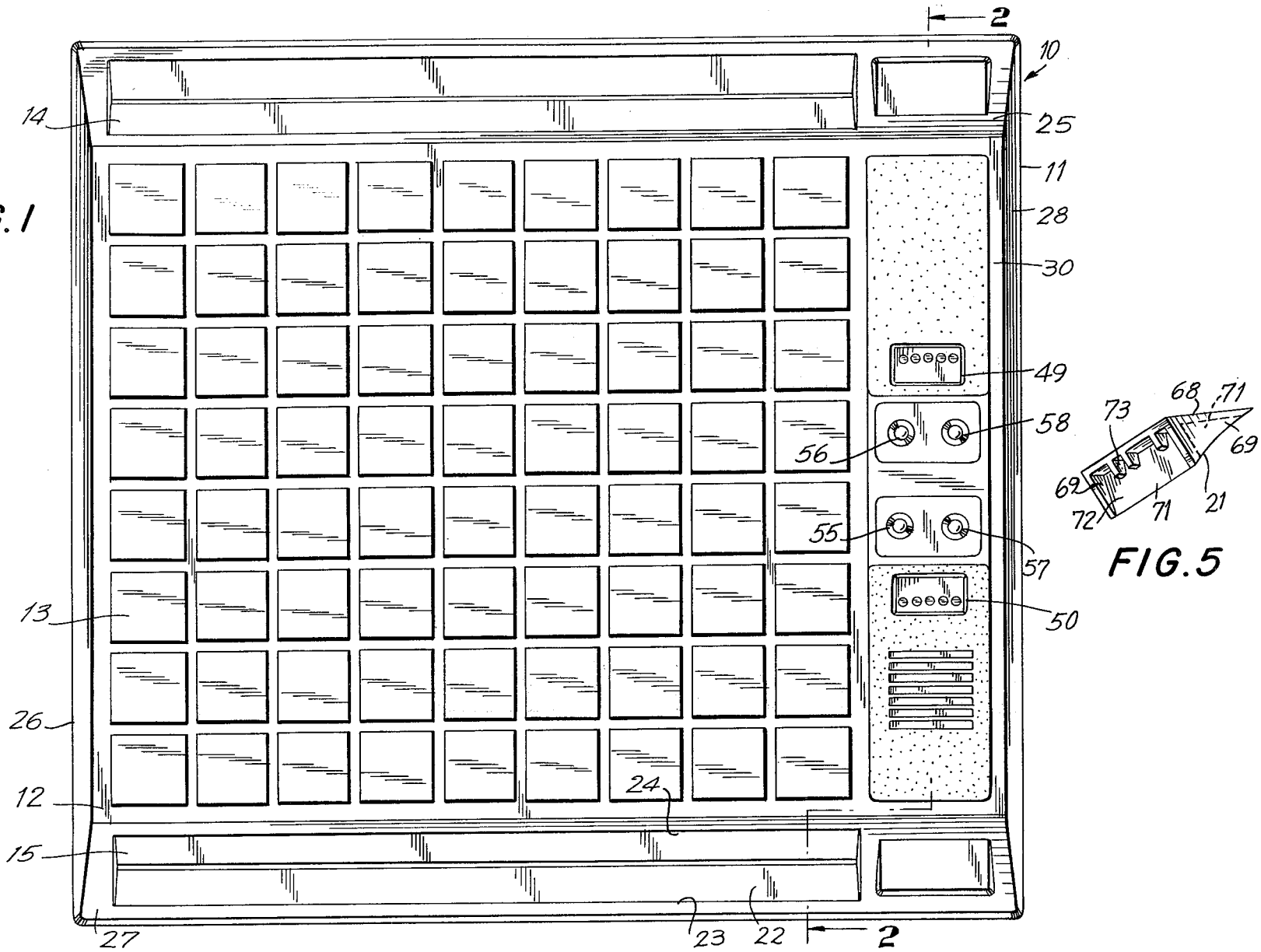
FIG. 1 is a top plan view of a game board forming an embodiment of the invention.
FIG. 5 is a bottom perspective view of a playing piece showing a coding means.
Figure 2:
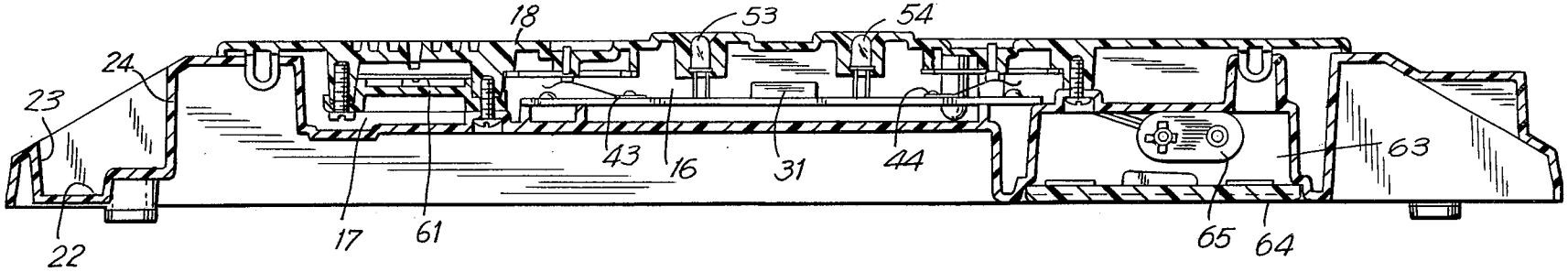
FIG. 2 is an offset transverse sectional view thereof, as seen from the plane 2—2 in FIG. 1.

In accordance with the invention, the device, generally indicated by reference character 10, comprises broadly: a base element 11, most conveniently formed of molded synthetic resinous materials. The base element includes an upper wall 12 defining a playing surface 13, first and second playing piece storage recesses 14 and 15, respectively, and first and second recesses 16 and 17 enclosing components of a decision making means. An elongated plate 18 overlies the recesses 16 and 17.

Playing surface 13 is conveniently divided into a plurality of squares not unlike that employed in a game of chess or checkers. As seen in FIG. 1, there are nine files and eight ranks, although this particular configuration is to be considered as purely exemplary. Bordering the surface 13 along two opposite sides are the storage recesses 14 and 15, each of length corresponding to that of the playing surface, and including a bottom wall 22 and side walls 23 and 24. The base element 11 is enclosed by four converging side walls 25, 26, 27 and 28.

Figure 3:
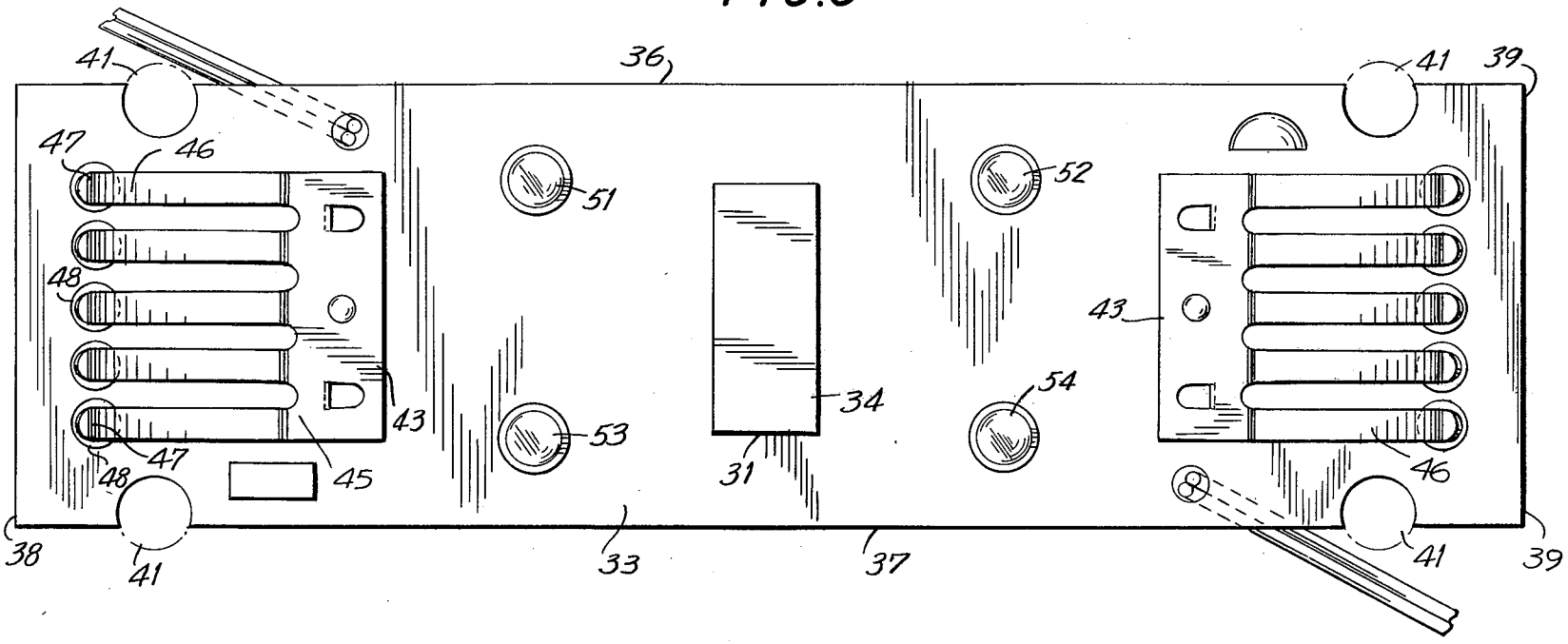
FIG. 3 is a top plan view of a printed circuit card forming a part of an electromechanical decision making means.
Figure 4:
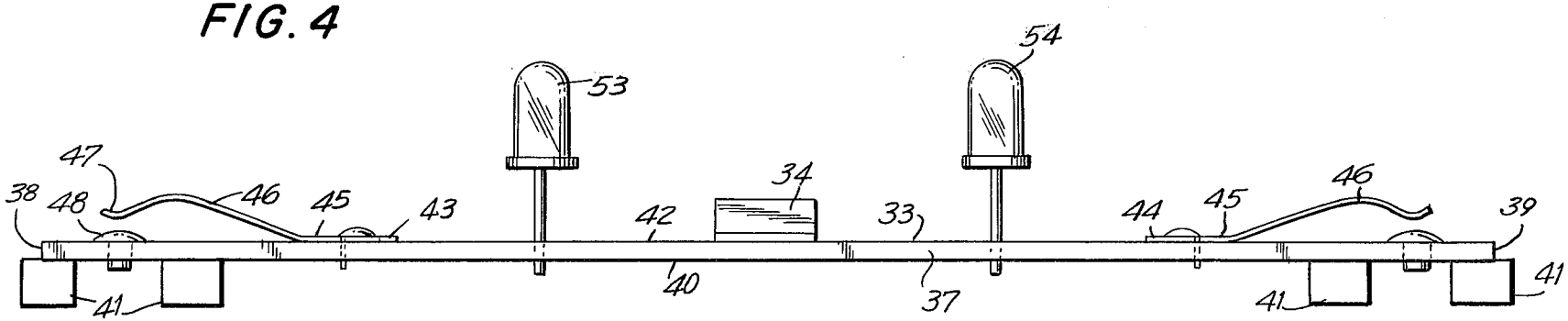
FIG. 4 is a side elevational view of the printed circuit card as seen from the lower portion of FIG. 3.

Situated in an area 30 bordering the wall 28 is an electromechanical decision making means generally indicated by reference character 31. Referring to FIGS. 3 and 4 in the drawing, the means 31 includes a printed circuit card element 33 mounting an integrated circuit comparator element 34.

The card element 33 is of generally planar rectangular form, and is bounded by longitudinal edges 36 and 37, and end edges 38 and 39. A lower surface 40 is provided with locating posts 41 to position the same with respect to the base element 11. An upper surface 42 mounts first and second finger switches 43 and 44, each including a base portion 45 and five fingers 46 necessary for the determination of a four bit code on each of the playing pieces 21 (FIG. 5). The ends 47 of each of the fingers 46 selectively contact corresponding rivets 48, depending upon the particular code involved.

When the device is assembled, the finger switches 44 are positioned at the lower end of recesses 49 and 50 into which compared playing pieces 21 are inserted during a comparison sequence.

The card element 23 mechanically supports four light emitting diodes 51, 52, 53 and 54 which are positioned in corresponding openings 55, 56, 57 and 58 of the plate or cover 18. The base element 11 also accommodates a piezo electric transducer 61 which produces an audible signal on demand.

A recess 63 accessible through a door 64 from a lower surface of the base element 11 accommodates a small dry cell battery, 65 preferably of 9-volt type.

FIG. 5 illustrates a typical playing piece 21, which is preferably formed integrally as a molding from synthetic resinous materials. It includes a forward wall 68, side wall 69, and a lower wall 71 which cooperate to form an upper recess 71 and a lower recess 72. The lower recess 72 is provided with ribs 73 corresponding to the assigned code for the particular playing piece. The upper recess forms a sheltered area in which a visual display of an identical value may be shielded to permit viewing only by the holder of the piece.

GAME PLAY

In the preferred embodiment, there are provided 42 movable pieces consisting of two sets of 21 pieces in two different colors (e.g. red and black). The pieces are all of the same external shape and are marked only on the side facing the operating player with the respective ranks. Opposing players do not know the rank of the piece they encounter during play, or even after they are identified by the decision making means, except as to relative value. The pieces are assigned the following binary number range which is transmitted through the finger switches for comparison.

| Quantity | Rank | Code | Decimal Value | |
|---|---|---|---|---|
| 1 each | Flag | 0000 | 0 | |
| 6 each | Privates | 0001 | 1 | |
| 1 each | Sergeant | 0010 | 2 | |
| 1 each | 2nd Lieutenant | 0011 | 3 | |
| 1 each | 1st Lieutenant | 0100 | 4 | |
| 1 each | Captain | 0101 | 5 | |
| 1 each | Major | 0110 | 6 | |
| 1 each | Lt. Colonel | 0111 | 7 | |
| 1 each | Colonel | 1000 | 8 | |
| 1 each | Brigadier General | 1001 | 9 | |
| 1 each | Major General | 1010 | 10 | |
| 1 each | Lt. General | 1011 | 11 | |
| 1 each | General | 1100 | 12 | |
| 1 each | Chief of Staff | 1101 | 13 | |
| 2 each | Spies | 1110 | 14 | |
| | Null Condition | 1111 | 15 | (Switch Open) |

The code assumes that switch closure is zero (low) and switch open is 1 (high).

If desired, marker pieces (not shown) may be used to mark a square for when pieces are removed for comparison purposes. The object of the game is to capture the opponent's flag. The pieces are arranged by each player in random order on his side of the board. The opponents do not have any a priori knowledge of how the ranks on the opposite side are arrayed. One side commences movement, motion is one square at a time along a rank or file or diagonally. When a piece is moved into a square occupied by an opposing piece a "battle" is started, the outcome of which is decided by the decision making means.

Figure 6:
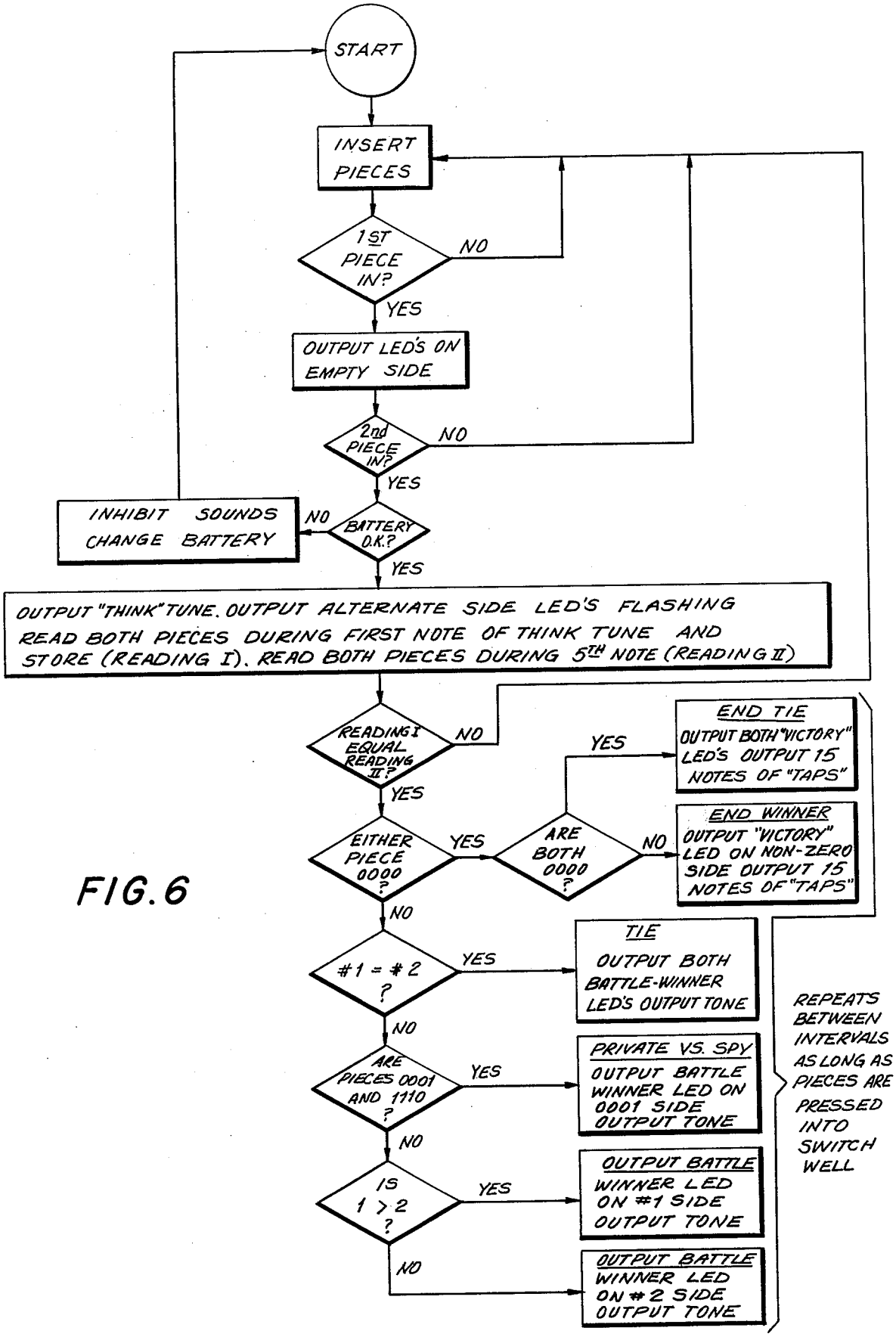
FIG. 6 is a flow chart showing the software program of the decision making means.

When battle is joined, the pieces are removed from the board, and the attacker marks the square with his marker. Pieces are then placed in the switch wells at the side of the board. Pressing down on the pieces actuates the finger switches, and the decision making means goes through a "thinking period" of one or two seconds while it compares the value of the two pieces in question and then announces its decision. The algorithm for decision making is illustrated in the flow chart shown in FIG. 6. Optionally, during the "thinking" period, a tune may be played through the transducer.

The visual outputs of decisions as well as the state of charge of the battery are shown on the light emitting diodes 51–54, inclusive, two of which are used to indicate "battle winner", and two of which are used to indicate "victory". As a variation from the normal procedure of indicated "battle winner" in terms of relative rank, an exception is made for the capture of a spy by a private, in which case the side holding the private wins. In all other cases, upon the capture of any piece, the light emitting diode on the side of the piece of higher value is eliminated. Should the capture of pieces be of equal value, both "battle winner" light emitting diodes are illuminated, and the attacking side claims the win. Upon the capture of one or both flags, the game ends in a victory or a tie. Optionally, the bugle call "Taps" may be played through the transducer.

Figure 7:
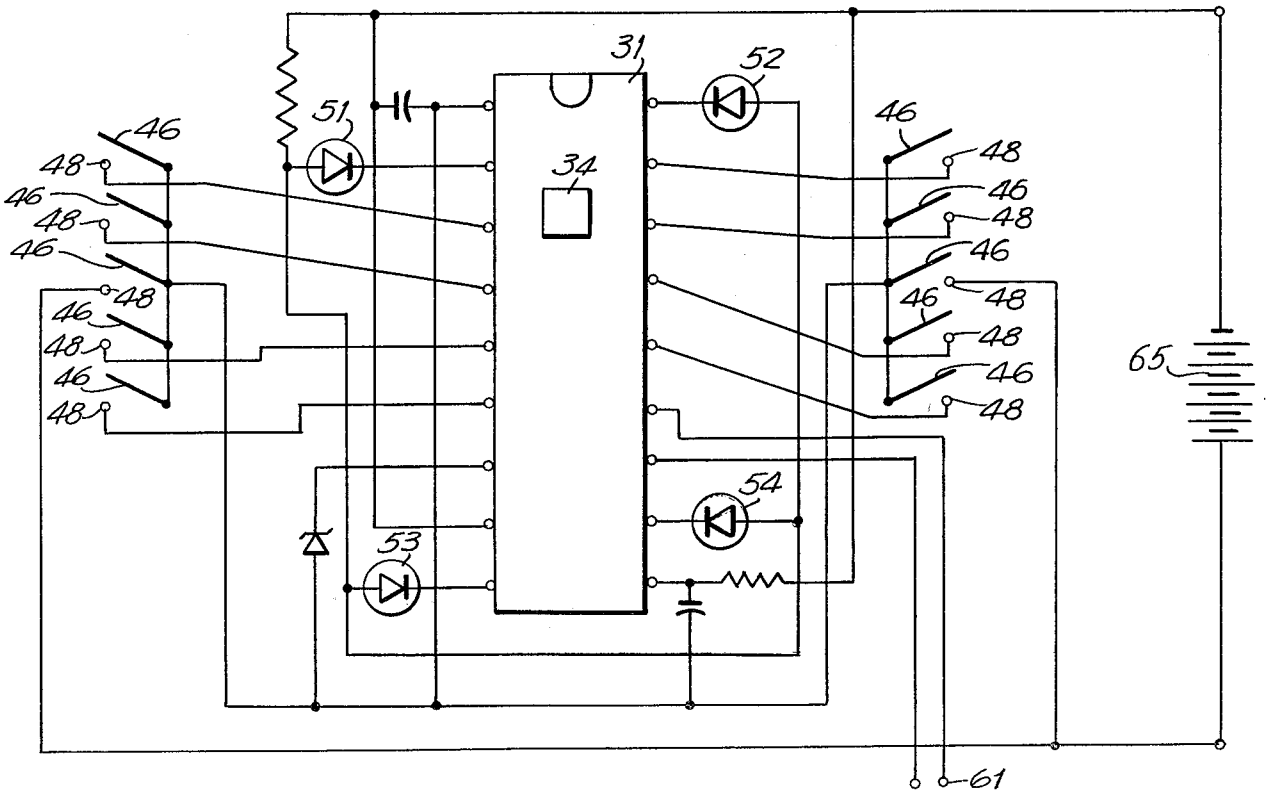
FIG. 7 is an electrical schematic view showing circuit card circuitry.

FIG. 7 shows a typical schematic for the integrated chip circuitry of the decision making means, the details of which are well known in the art, and outside the scope of the present disclosure.

It is to be understood that it is not considered that the invention lies in the specific details of structure shown and set forth in this specification, for obvious modifications will occur to those skilled in the art to which the invention pertains.

What is claimed is:

1. An electromechanical decision making board game comprising in combination: a game board element having an upwardly disposed playing surface delineated into plural areas for the accommodation of individual playing pieces; a pair of sets of individual playing pieces selectively positionable upon said areas, each piece having an established value and code means indicating said value available from a surface of said piece; reading means adjacent to said available surface for reading said code, and means for comparing a pair of code means on separate pieces to determine which piece has the higher value; said code means being in the form of plural aligned projections positioned upon said surface of said pieces said projections being positioned in such a manner to establish a 4 bit code by the absence or location of a projection with respect to a plurality of aligned switches comprising, said reading means wherein said plurality of aligned switches are selectively closed by contact with said projections.

2. A game in accordance with claim 1, including a pair of reading means each feeding a signal to a single comparator means whereby the value of a selected pair of playing pieces may be simultaneously compared.

3. A game in accordance with claim 2, including visual means indicating the result of a comparative function.

4. A game in accordance with claim 1, further characterized in each playing piece having a shielded surface visibly indicating the value of the piece, the remaining surfaces of each piece being identical to the corresponding surfaces of the other pieces, whereby with proper orientation, the value of each piece is visible only to a single player.

* * * * *